US011015328B2

(12) United States Patent
Lu et al.

(10) Patent No.: US 11,015,328 B2
(45) Date of Patent: May 25, 2021

(54) SENSOR INSTALLATION ASSEMBLY, FAUCET AND SENSOR INSTALLATION METHOD

(71) Applicant: XIAMEN IEBS HI-TECH CO., LTD, Xiamen (CN)

(72) Inventors: Yang Lu, Xiamen (CN); Xinxing Wang, Xiamen (CN)

(73) Assignee: XIAMEN IEBS HI-TECH CO., LTD., Fujian (CN)

( * ) Notice: Subject to any disclaimer, the term of this patent is extended or adjusted under 35 U.S.C. 154(b) by 16 days.

(21) Appl. No.: 16/162,566

(22) Filed: Oct. 17, 2018

(65) Prior Publication Data

US 2020/0087904 A1 Mar. 19, 2020

(30) Foreign Application Priority Data

Sep. 17, 2018 (CN) ..... 201811078836.8

(51) Int. Cl.
*E03C 1/05* (2006.01)
*E03C 1/04* (2006.01)

(52) U.S. Cl.
CPC ..... *E03C 1/057* (2013.01); *E03C 1/0404* (2013.01); *Y10T 137/9464* (2015.04)

(58) Field of Classification Search
CPC .. Y10T 137/9464; E03C 1/057; E03C 1/0404
See application file for complete search history.

(56) References Cited

U.S. PATENT DOCUMENTS 5,758,688 A * 6/1998 Hamanaka ..... E03C 1/057 137/624.11
6,127,671 A * 10/2000 Parsons ..... G01S 7/4813 250/221
10,267,432 B2 * 4/2019 Tsai ..... F16K 37/005
2007/0246550 A1 * 10/2007 Rodenbeck ..... G05D 23/1353 236/12.11
2008/0156384 A1 * 7/2008 Chen ..... E03C 1/057 137/801
2010/0071126 A1 * 3/2010 Rudisser ..... E03C 1/057 4/623
2011/0233295 A1 * 9/2011 Yewdall ..... E03C 1/044 239/1

(Continued)

*Primary Examiner* — Marina A Tietjen
*Assistant Examiner* — Frederick D Soski
(74) *Attorney, Agent, or Firm* — Muncy, Geissler, Olds & Lowe, P.C,

(57) ABSTRACT

Provided is a sensor installation assembly relating to the faucet field and comprising a fixing base, a sensor and a fixing bolt, wherein the fixing base is in a shape matched with an installation object and is at least provided with installation guide grooves in sliding fit with a sensor and insert grooves allowing the fixing bolt to be inserted therein in a matched manner so as to limit the sensor in the installation guide grooves; the sensor is in sliding fit with the installation guide grooves; and the fixing bolt is inserted into the insert grooves of the fixing bolt in the matched manner. Also provided is a faucet at least comprising a water outlet base provided with the sensor installation assembly, and a sensor installation method. The sensor installation improvement technique is more adaptable and applicable to various faucet structures, and assembly is very convenient.

12 Claims, 17 Drawing Sheets

(56) References Cited

U.S. PATENT DOCUMENTS

| | | | | |
|---|---|---|---|---|
| 2012/0305118 | A1* | 12/2012 | Itazu | E03C 1/057 137/801 |
| 2013/0248019 | A1* | 9/2013 | Frick | E03C 1/0401 137/468 |
| 2014/0116553 | A1* | 5/2014 | Schoolcraft | E03C 1/057 137/801 |
| 2016/0032572 | A1* | 2/2016 | Chen | E03C 1/0403 137/78.1 |
| 2017/0218608 | A1* | 8/2017 | Chen | E03C 1/057 |

* cited by examiner

SENSOR INSTALLATION ASSEMBLY, FAUCET AND SENSOR INSTALLATION METHOD

BACKGROUND OF THE INVENTION

Technical Field

The invention relates to the field of faucets, in particular to faucets provided with sensors.

Description of Related Art

Faucets with sensors (generally infrared sensors) can bring convenience to people and are widely used nowadays. Sensors are installed at different positions of faucets according to different design requirements. As for common faucets applied to sinks, sensors are generally installed on the outer walls of tubular water outlet bases in an embedded manner so as to accurately acquire hand gestures. In order to install the sensors on the outer wall of the water outlet bases of the faucets in the embedded manner, the following technical means are generally adopted in the prior art:

A, Referring to FIG. 1 and FIG. 2, an installation through hole 61' is formed in a tubular water outlet base 6, a threaded hole is formed in one side of the inner wall of the water outlet base 6 and corresponds to the installation through hole 61', a sensor 2' is correspondingly provided with a lug 24 matched with the threaded hole and provided with an installation hole, after the sensor 2' is embedded into the installation through hole 61' of the water outlet base 6, the lug 24 is locked into the threaded hole, formed in the inner wall of the water outlet base 6 and located on the periphery of the installation through hole 61', through a bolt 9, and thus, the sensor 2' is installed on the outer wall of the tubular water outlet base 6 in the embedded manner. However, due to the fact that it is difficult to perform operation with common tools in the narrow space of an inner cavity of the water outlet base 6, a water outlet base 6 provided with a manual valve installation hole is usually used (such as the water outlet base disclosed in Chinese Patent Publication No. CN201827484U). According to the water outlet base 6 provided with the manual valve installation hole, a sensor installation through hole 61' is formed in a position, right facing a valve element installation hole 62, of the water outlet base 6, and thus, before a valve element is installed in the valve element installation hole 62, a tool can be inserted via the valve element installation hole 62 to lock the sensor 2', and then the valve element is installed in the valve element installation hole 62. Obviously, this technical means inevitably has the technical defect of difficult installation, and meanwhile, there are few choices for the installation position of the sensor 2'.

B, An installation through hole is formed in a tubular water outlet base, a rectangular clamping groove is formed in one side of the inner wall of the water outlet base and corresponds to the periphery of the installation through hole, and a baffle part extending outwards is circumferentially disposed on the back side of a sensor; after the sensor is embedded into the installation through hole of the water outlet base, the baffle part abuts against the periphery of the installation through hole in one side of the inner wall of the water outlet base, so that the sensor is prevented from falling out of the installation through hole; and afterwards, a rubber pad is inserted between the rear end of the sensor and the rectangular clamping groove, so that the sensor is prevented from falling inwards after being installed on the outer wall of the water outlet base in an embedded manner, and accordingly, the sensor is reliably installed on the outer wall of the water outlet base in the embedded manner. This technical means is superior to technical mean A in that the installation position of the sensor is more flexible and has more options. However, as the water outlet base is generally made from metal, it is very difficult to machine the rectangular clamping groove in the inner wall of the water outlet base; besides, the space of an inner cavity of the water outlet base is very limited and is further narrowed by the rectangular clamping groove, and consequentially, the installation space for other elements in the water outlet base is decreased, and installation and structural design will be more challengeable; and in addition, in order stably and reliably fix the sensor, the rubber pad should be assembled through extrusion, which is very difficult.

C, On the basis of technical means B, an improvement is made by using a sleeve to replace the rectangular clamping groove in the inner wall of the water outlet base, for instance, in the scheme disclosed by Chinese Patent Publication No. CN 105864492B, a rubber ring (73) still needs to be assembled between a sensor module (72) and a modular window (611) of the sleeve (61) through extrusion, and consequentially, this technical means still have the defect of high assembly difficulty.

D, Referring to FIG. 3 and FIG. 4, a round installation through hole 61' is formed in a tubular water outlet base 6, L-shaped clamping grooves 63 are formed in the inner wall of the water outlet base 6 and respectively correspond to two sides of the installation through hole 61', and both wings of a circular sensor are provided with clamping parts 25 extending outwards; the clamping parts 25 on both wings of the sensor are made in a vertical state first and then disposed in the installation through hole 61' in a sleeved manner, and afterwards, the sensor 2' is rotated to clamp the clamping parts 25 on both wings into the L-shaped clamping grooves 63, which are formed in the inner wall of the water outlet base 6 and correspond to the two sides of the installation through hole 61'; the clamping parts 25 on both wings of the sensor are made in a horizontal state to be matched with the L-shaped clamping grooves 63 in the two sides of the installation through hole 61', and thus, the sensor 2' is reliably installed on the outer wall of the tubular water outlet base 6 in an embedded manner. Compared with the above technical means, this technical means has the advantages of simple structure and convenient assembly, but this technical means is only applicable to installation of round sensors.

In view of various defects of the prior art, a sensor installation assembly which is more adaptable and universal and beneficial to assemble is needed to meet the production requirement of faucets provided with sensors.

BRIEF SUMMARY OF THE INVENTION

In view of this, the invention provides a sensor installation improvement technique to meet the aforesaid requirement.

The technical solutions of the invention are as follows:

One technical solution of the invention provides a sensor installation assembly, which is so design that a sensor is fixed through a sliding fit mechanism and an insertion fit structure used for limiting the sliding fit mechanism.

Particularly, the sensor installation assembly comprises:

a fixing base, wherein the fixing base is in a shape matched with an installation object and is at least provided with installation guide grooves and insert grooves, wherein the installation guide grooves are configured to be in sliding fit with a sensor, and the insert grooves are configured to allow a fixing bolt to be inserted therein in a matched manner so as to limit the sensor in the installation guide grooves;

a sensor, wherein the sensor is in sliding fit with the installation guide grooves of the fixing base; and a fixing bolt, wherein the fixing bolt can be inserted into the insert grooves of the fixing base in a matched manner.

Furthermore, the fixing base is of a tubular structure provided with a hollow inner cavity.

Furthermore, the fixing base is provided with a notch, and the installation guide grooves are formed in two sides of the notch.

Furthermore, the installation guide grooves are formed in the radial direction of the fixing base.

Furthermore, a connecting strip is disposed at the notch of the fixing base and is used for connecting two ends of the notch.

Furthermore, the insert grooves are formed in two sides of the notch.

Furthermore, the insert grooves are formed in the axial direction of the fixing base and are communicated with the installation guide grooves.

Furthermore, a flared guide structure is disposed at an opening of each insert groove.

Furthermore, the fixing bolt is of an n-shaped structure or is formed by two T-shaped insert pins.

Furthermore, the sensor comprises installation convex blocks used to be in sliding fit with the installation guide grooves of the fixing base.

Furthermore, the sensor further comprises a sensor protrusion and an installation abutting face wider than the sensor protrusion.

Furthermore, the width of the installation convex blocks is smaller than the length of the installation guide grooves. Defining the ends, towards the sensor protrusion in the width direction, of the installation convex blocks as front ends and the other ends of the installation convex blocks as rear ends, the fixing bolt abuts against the rear ends, in the width direction, of the installation convex blocks after being inserted into the insert grooves of the fixing base in the matched manner.

Furthermore, the sensor installation assembly further comprises a washer disposed around the sensor protrusion.

Furthermore, the fixing base is further provided with a positioning structure used to prevent circumferential sliding.

A second technical solution of the invention provides a faucet. The faucet at least comprises a water outlet base, wherein the above-mentioned sensor installation assembly is installed on the water base.

A third technical solution of the invention provides a sensor installation method. The sensor installation method comprises the following steps:

A, providing a water outlet base provided with an installation through hole, and providing the sensor installation assembly as mentioned above;

B, disposing the fixing base into an inner cavity of the water outlet base;

C, guiding the sensor in and slidably installing the sensor into the installation guide grooves of the fixing base; and D, inserting the fixing bolt into insert grooves of the fixing base in a matched manner.

By adoption of the sensor installation improvement technique, the sensor installation assembly is more adaptable and applicable to various faucet structures, and assembly is very convenient.

DETAILED DESCRIPTION OF THE INVENTION

Figure 1:
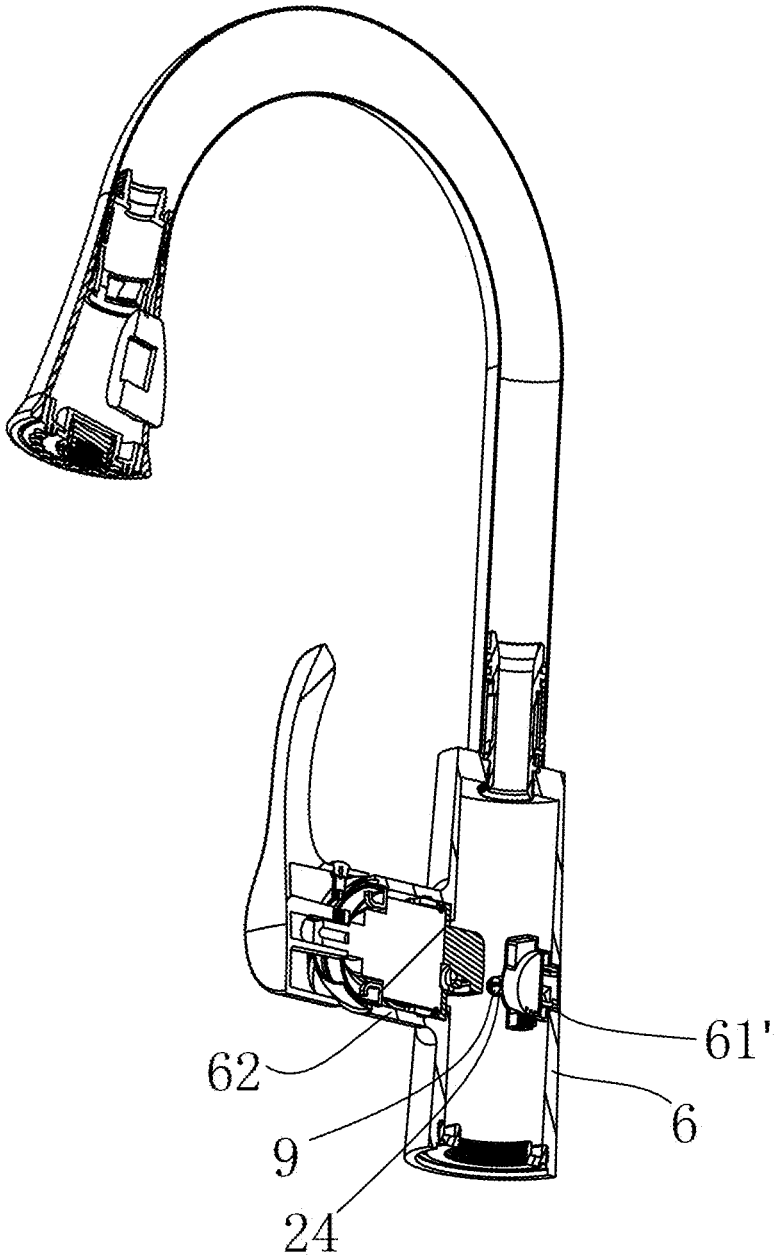
FIG. 1 Prior Art
FIG. 1 is a cross-sectional view of a faucet adopting existing technical means A.
Figure 2:
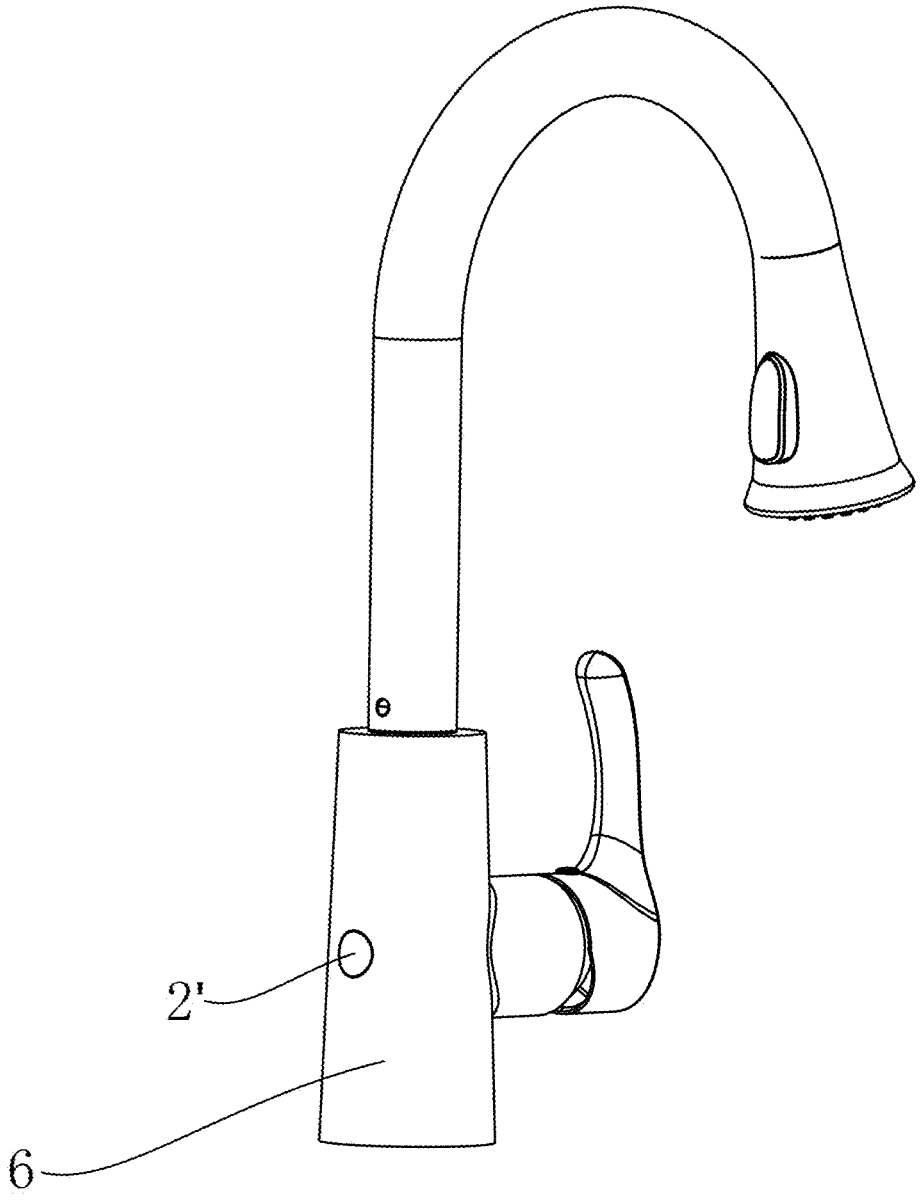
FIG. 2 Prior Art
FIG. 2 is an assembled perspective view of the faucet adopting the existing technical means A.
Figure 3:
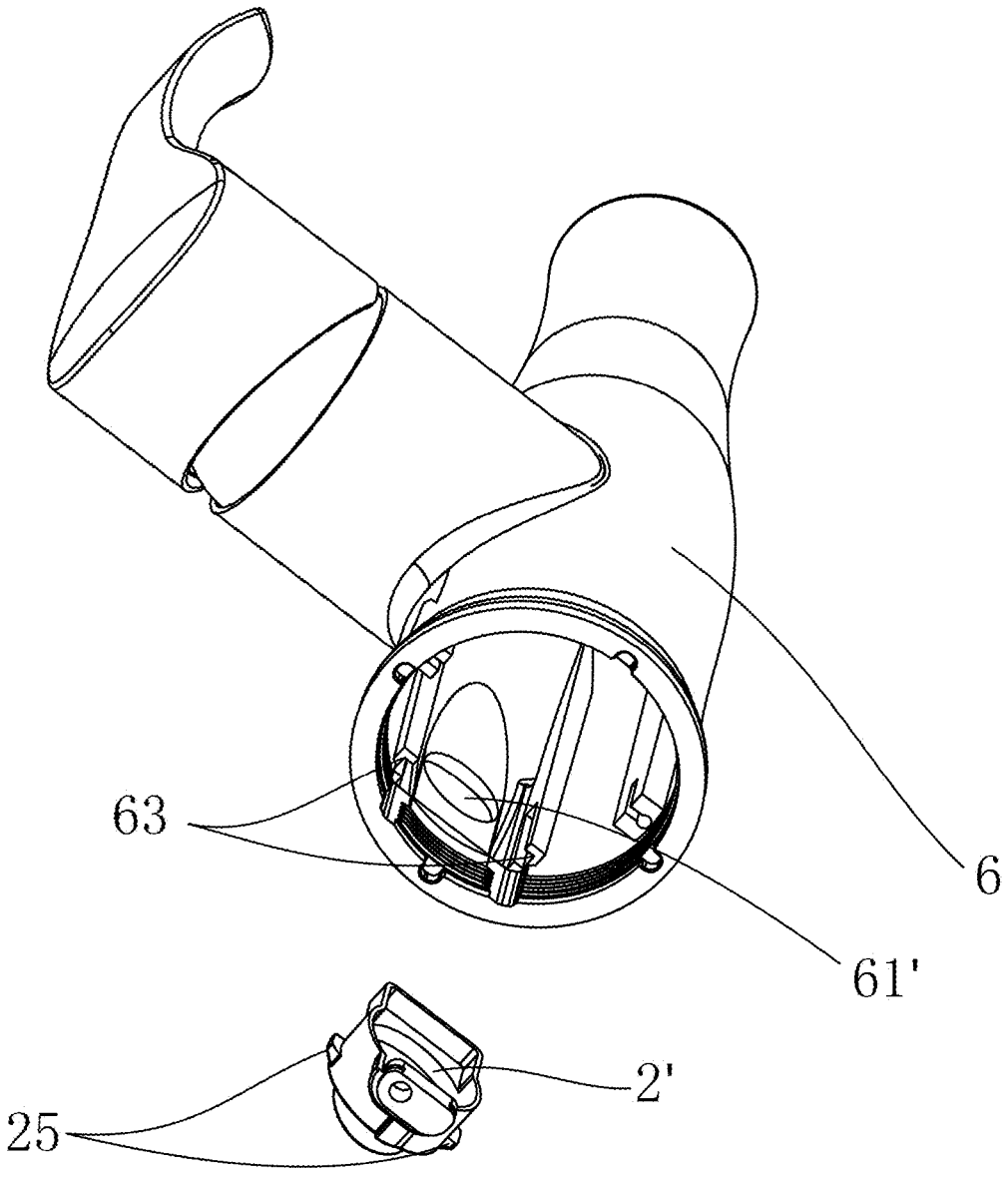
FIG. 3 Prior Art
FIG. 3 is an exploded perspective view of a water outlet base adopting existing technical means B.
Figure 4:
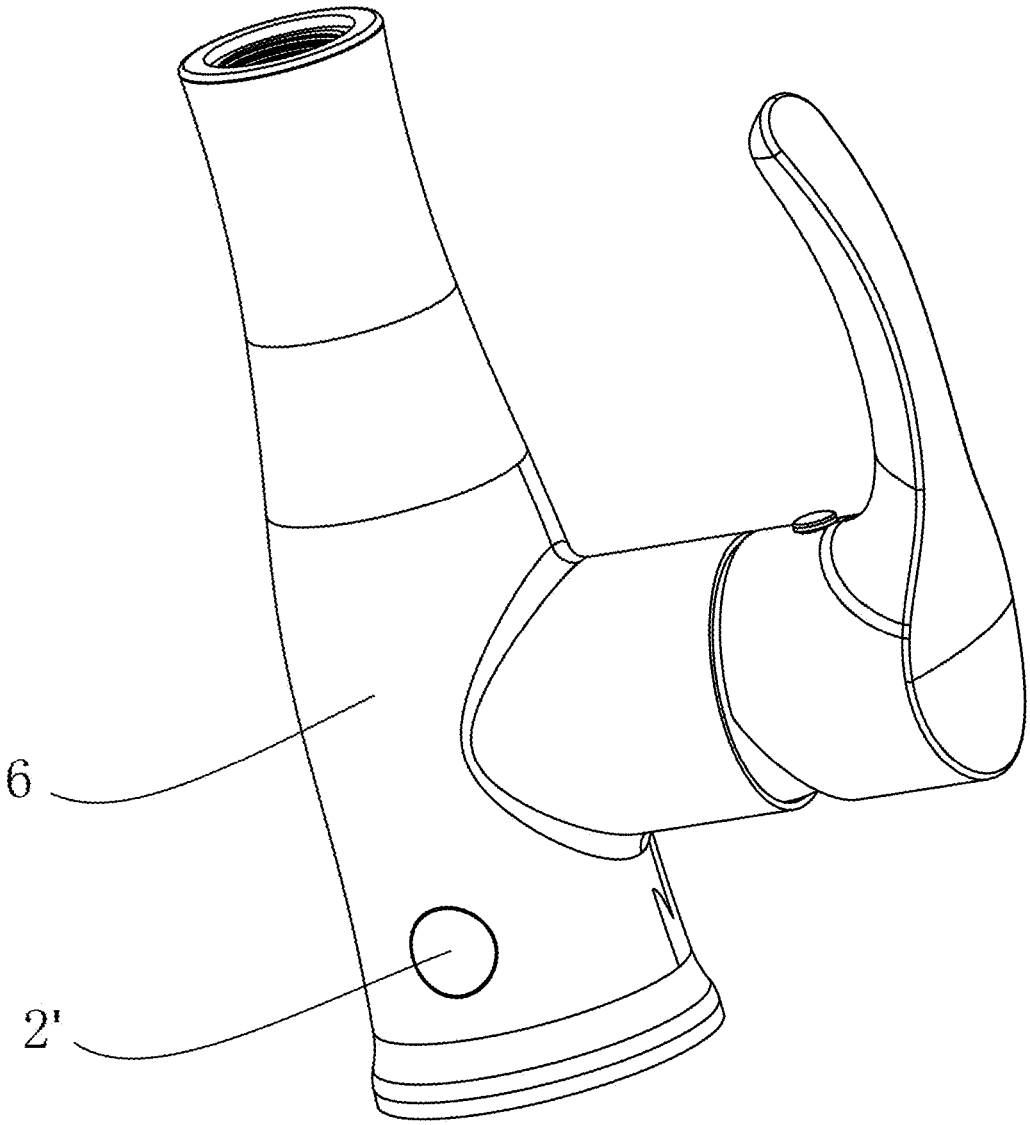
FIG. 4 Prior Art
FIG. 4 is an assembled perspective view of the water outlet base adopting existing technical means B.
Figure 5:
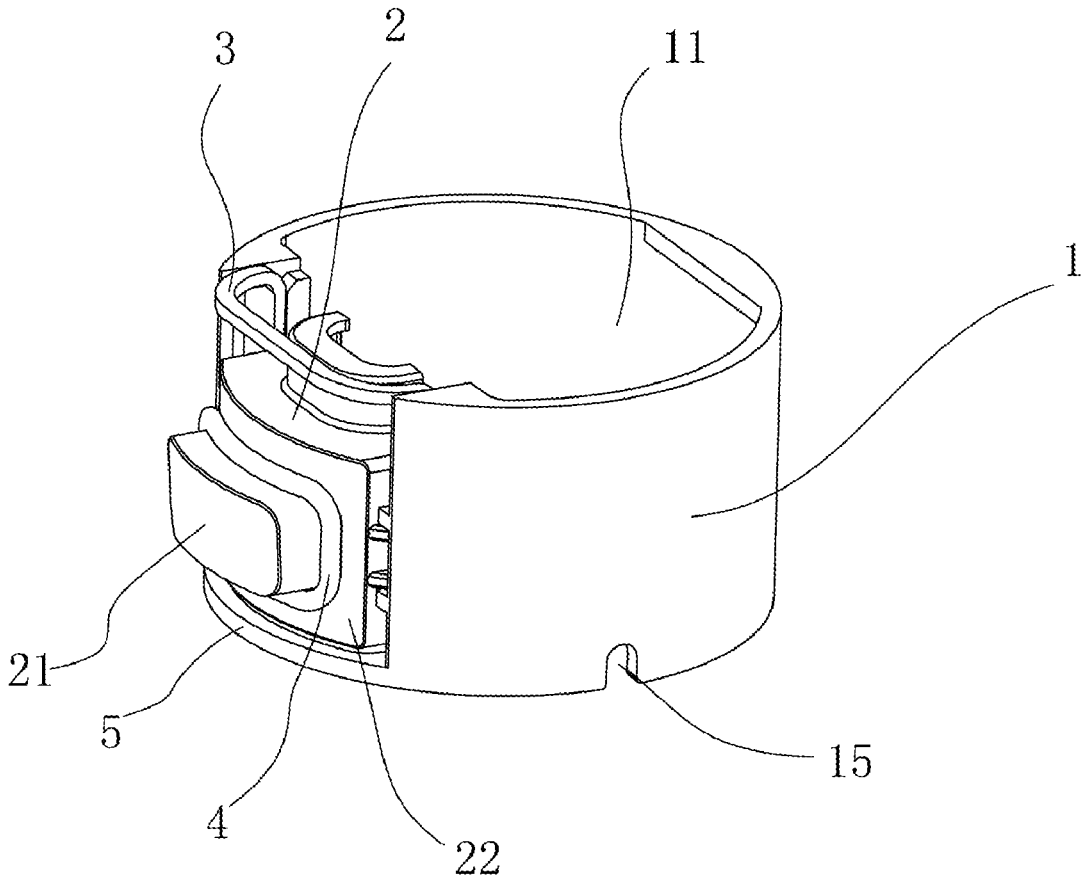
FIG. 5 is an assembled view of embodiment 1 (perspective view 1)
Figure 6:
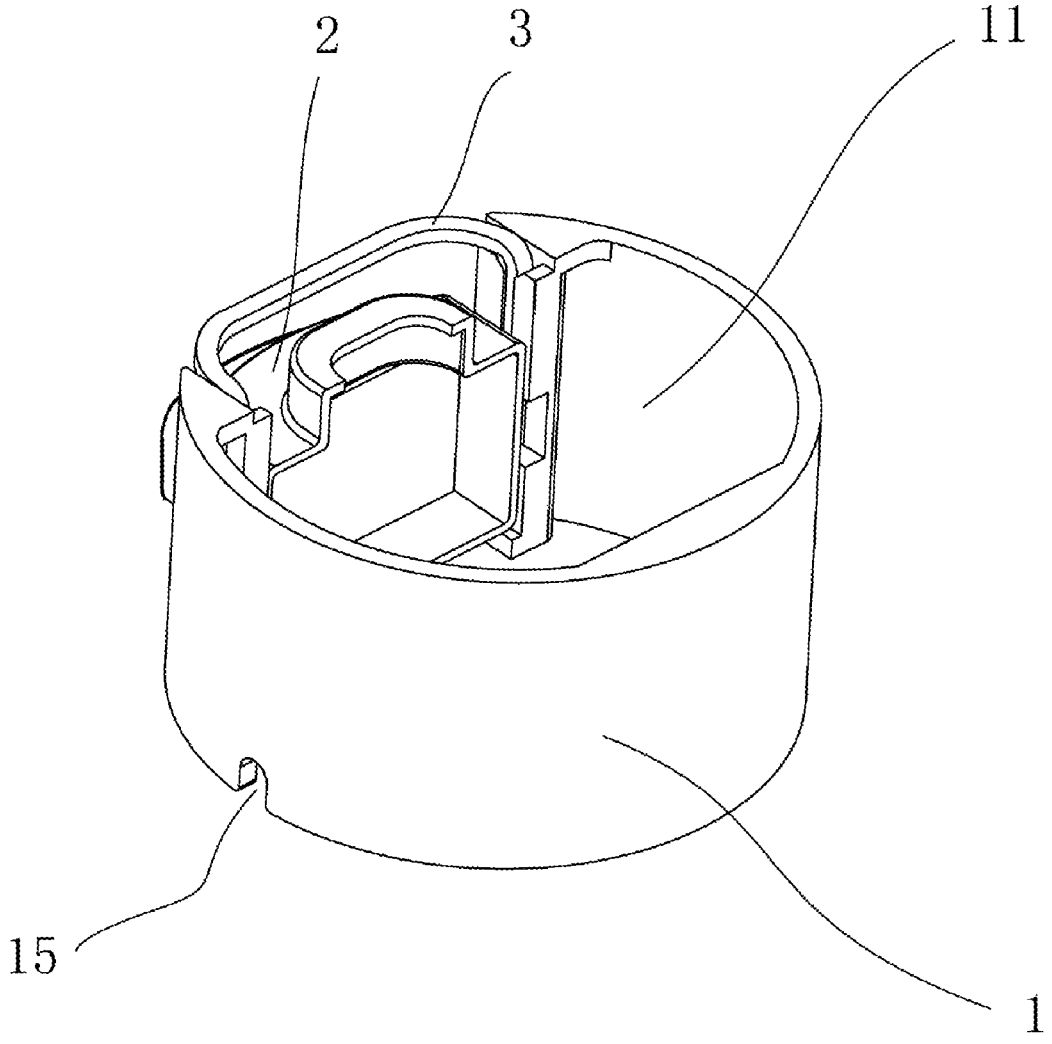
FIG. 6 is an assembled view of embodiment 1 (perspective view 2)
Figure 7:
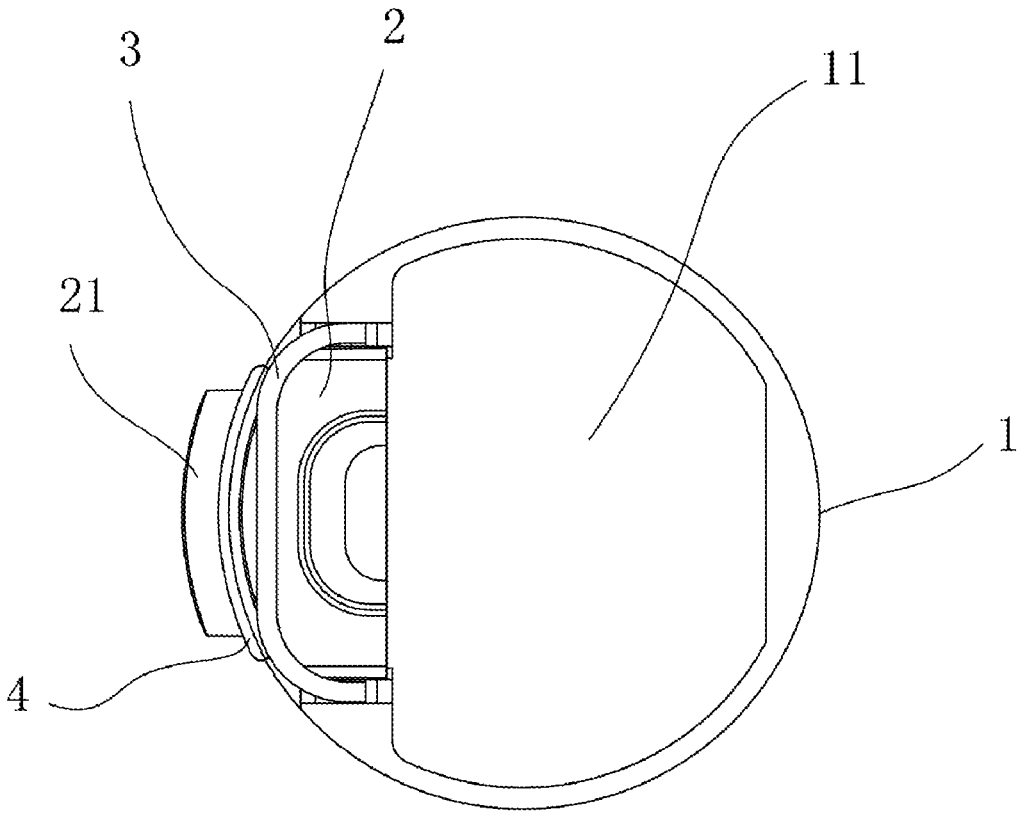
FIG. 7 is an assembled view of embodiment 1 (top view)
Figure 8:
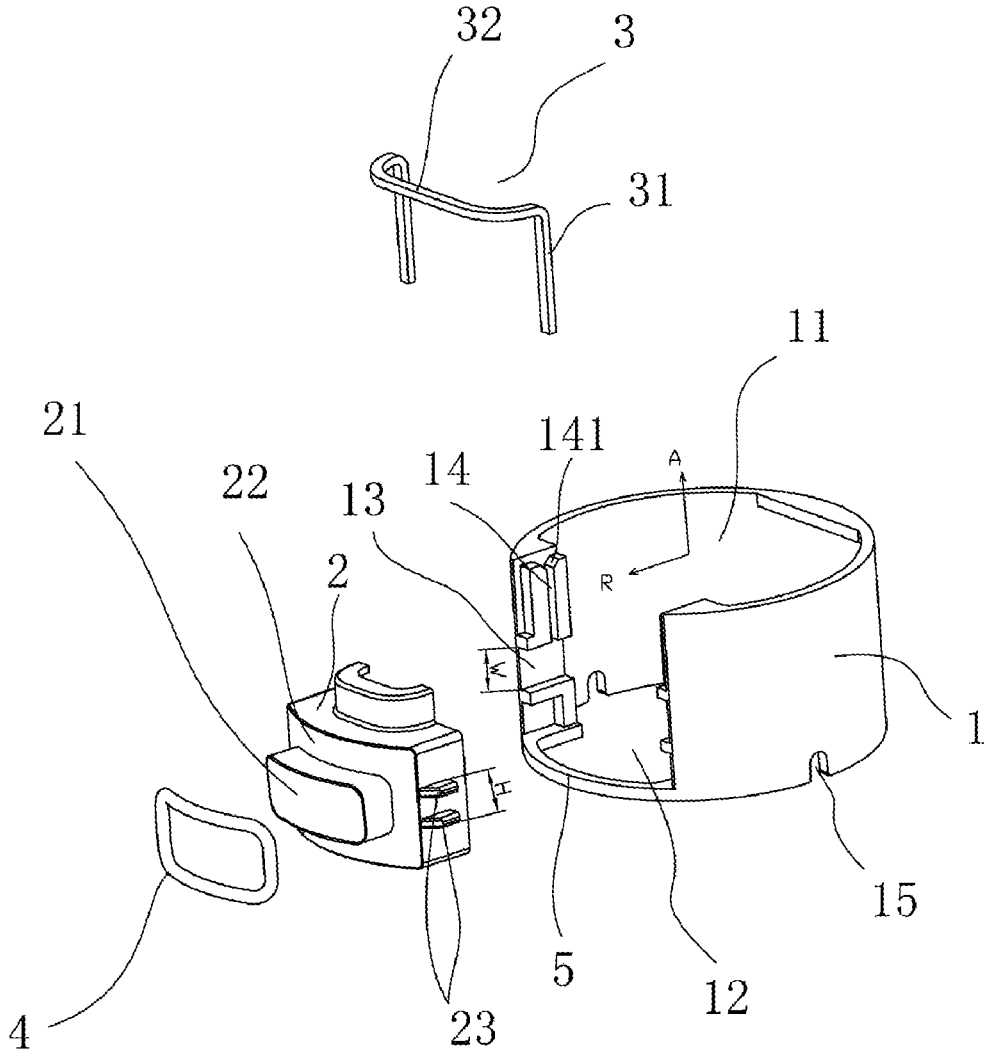
FIG. 8 is an exploded view of embodiment 1 (perspective view 1)
Figure 9:
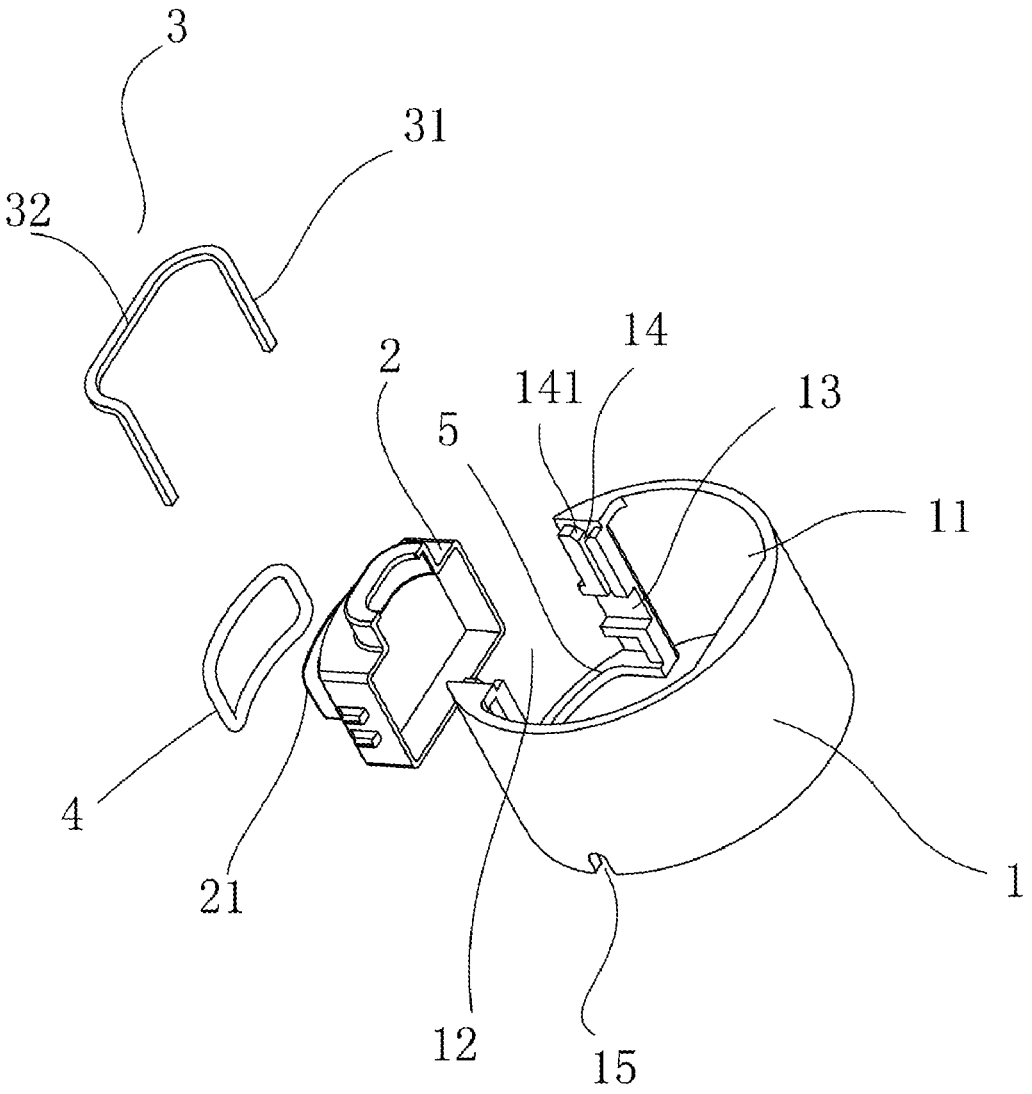
FIG. 9 is an exploded view of embodiment 1 (perspective view 2)

Accompanying drawings are provided to expound embodiments of the invention. These drawings are one part of contents disclosed the invention and are mainly used to illustrate the embodiments and to explain the operating principles of the embodiments in cooperation with relevant contents in the specification. By referring to these contents, those ordinarily skilled in this field can understand other possible embodiments and advantages of the invention. Components in these drawings are drawn out of scale, and similar reference signals generally represent similar components.

The invention is further described below with reference to the accompanying drawings and specific embodiments.

Embodiment 1

Referring to FIGS. 5-9 showing a sensor installation assembly, the sensor installation assembly mainly comprises a fixing base 1, a sensor 2 and a fixing bolt 3 and can additionally comprise a washer 4 used to provide buffering protection for the sensor 2. FIGS. 5-9 show the sensor installation assembly in a direction beneficial to installation operation (FIG. 10-14 for other embodiments show relevant components in the same way). During installation operation, a water outlet base 6 is generally placed with an installation opening facing upwards so as to allow the sensor installation assembly to be installed therein, and after being installed in the tubular water outlet base 6, the sensor installation assembly is in a direction opposite to the direction shown in the figures when a faucet is in use.

The shape of the fixing base 1 is matched with the shape of an inner cavity of the water outlet base 6 in which the fixing base 1 is to be installed. In this embodiment, as the fixing base 1 is installed in the tubular water outlet base 6, the fixing base 1 has an appearance with an arc surface matched with the cylindrical inner cavity and is approximately cylindrical in appearance. In addition, a hollow inner cavity 11 is formed in the center of the fixing base 1 so as to provide an operation space when the sensor 2 is installed and to allow a pipeline and other parts of the faucet to penetrate through. Additionally, the cylindrical sleeve-shaped fixing base 1 is provided with a notch 12 where the sensor 2 is to be installed, and thus, the fixing base 1 in this embodiment is mainly in the shape of a hollow cylindrical sleeve provided with the notch 12. The fixing base 1 is basically in the shape of a complete cylindrical sleeve in appearance after the sensor 2 is installed in the notch 12. If permissible, a connecting strip 5 can be disposed at the notch 12 so as to connect both ends of the notch 12, as shown in this embodiment, so that the strength of the fixing base 1 is improved, and the fixing base 1 is smoother in appearance so as to be guided into the inner cavity of the water outlet base 6 more easily. Installation guide grooves 13 used to guide in the sensor 2 for installation are formed in two sides of the notch 12 of the fixing base 1, and the configuration direction of the installation guide grooves 13 is consistent with the installation direction of the sensor 2, which means that the installation guide grooves 13 are basically configured in the radial direction R of the fixing base 1. Meanwhile, insert grooves 14 allowing the fixing bolt 3 to be inserted therein in a matched manner are formed in two sides of the notch 12. In this embodiment, the insert grooves 14 are basically configured in the axial direction A of the fixing base 1 and are perpendicularly communicated with the installation guide grooves 13. In other embodiments, as long as the fixing bolt can be inserted into the insert grooves and can limit the sensor sliding into the installation guide grooves of the fixing base after being inserted into the insert grooves, the configuration form of the insert grooves can be adjusted as needed. For instance, the insert grooves can be strip-shaped insert grooves, which are horizontally disposed and provided with openings extending, from two outer sides of the notch of the fixing base, towards the installation guide grooves to reach the installation guide grooves. Or, the insert grooves are obliquely disposed with respect to the axial direction A of the fixing base 1 so that the fixing bolt can be obliquely inserted and fixed into the insert grooves. Meanwhile, in this embodiment, in order to guide the fixing bolt 3 when the fixing bolt 3 is inserted into the insert grooves, openings of the insert grooves 14 are further provided with flared guide structures 141.

What needs to be additionally pointed out is that in order to preventing circumferential slipping of the fixing base 1 after the fixing base 1 is installed in the water outlet base 6, a positioning clamping notch 15 can be formed in the fixing base 1 to be matched with a positioning clamping block 64 in the inner cavity of the water outlet base 6 to achieve positioning. Of course, other positioning techniques capable of preventing circumferential slipping can also be adopted to achieve positioning and are matched with the fixing base to realize different implementations.

The sensor 2 comprises a sensor protrusion 21 and an installation abutting face 22 wider than the sensor protrusion 21. The sensor protrusion 21 can be disposed in an installation through hole 61 of the fixing base 6 to serve as an inductive acquisition window. The installation abutting face 22 wider than the sensor protrusion 21 abuts against the circumferential inner cavity face, corresponding to the installation through hole 61, of the water outlet base 6 after being installed, so that the sensor 2 is prevented from falling out; and the shape of the installation abutting face 22 is matched with the shape of the inner cavity of the water outlet base 6. In this embodiment, the washer 4 can be additionally disposed around the sensor protrusion 21 of the sensor 2 so as to provide buffering protection, and thus, the sensor 2 is prevented from being damaged by sharp burrs or edges of the installation through holes 61 of the water outlet base 6. In addition, the sensor 2 has two sides provided with installation convex blocks 23 to be installed in the installation guide grooves 13 in the two sides of the notch 12 of the fixing base 1 in a matched manner. The height H of the installation convex blocks 23 is matched with the width W of the installation guide grooves 13, which means that the height H of the installation convex blocks 23 is smaller than or equal to the width W of the installation guide grooves 13 so that the sensor 2 can smoothly slide into the installation guide grooves 13. Defining the dimension in the sliding direction of the installation convex blocks 23 as the width, the width of the installation convex blocks 23 is smaller than the length of the installation guide grooves 13 in this embodiment, so that when the sensor 2 slides into the installation guide grooves 13 of the fixing base 1 via the installation convex blocks 23 to be assembled in place, the fixing bolt 3 can be smoothly inserted into the insert grooves 14 of the fixing base 1 in place without being blocked by the installation convex blocks 23 (the fixing bolt 3 generally abuts against the surfaces of the lower ends of the installation guide grooves), and thus, the sensor 2 can be prevented from falling out by the fixing bolt 3 abutting against the sensor 2 through the rear ends, in the width direction of the installation convex blocks 23. Of course, in other embodiments, installation convex blocks of other structures can also be adopted. For instance, the installation convex blocks are configured to have a width equal to the length of the installation guide grooves and are provided with pin holes in positions, corresponding to the insert grooves, in the width direction, in this case, the fixing bolt can be inserted into the pin holes to pin the sensor, and thus, bidirectional sliding of the sensor on the installation guide grooves is limited; however, compared with the structural design of the installation convex blocks 23 in this embodiment, this implementation obviously has a higher assembly requirement, and meanwhile, by adoption of this implementation, the sensor 2 no longer need to be additionally provided with the installation abutting face 22 wider than the sensor protrusion 21.

In this embodiment, the sensor protrusion 21 has an approximately rectangular contour. The installation convex block 23 on each of the two sides of the sensor 2 is formed by two spaced flat plates to realize corresponding functions. Compared with the structure adopting one installation convex block 23' (shown in FIG. 15), the distance between the two outer sides is larger, and positioning is more stable. Of course, a whole high (thick) solid installation convex block with identical outer intervals can also be adopted to realize the same stable positioning effect, but by adoption of the installation convex blocks each formed by two spaced flat plates in this embodiment, materials can be saved.

The fixing bolt 3 at least comprises two insert pins 31 to be matched with the insert grooves 14 in the two sides of the notch 12 of the fixing base. In this embodiment, the fixing bolt 3 further comprises a middle connecting part 32 used for connecting the two insert pins 31, so that the fixing bolt 3 is approximately of an n-shaped integrated structure. The fixing bolt 3 of this structure can be directly formed by a thin metal bar through punching and is easy to manufacture. What needs to be additionally pointed out is that the middle connecting part 32 used for connecting the two insert pins of the fixing bolt 3 protrudes outwards in appearance, so that after the fixing bolt 3 is inserted into the insert grooves 14 of the fixing base 1, the hollow inner cavity 11 in the center of the fixing base 1 will not be blocked by the connecting part 32 protruding outwards.

Figure 15:
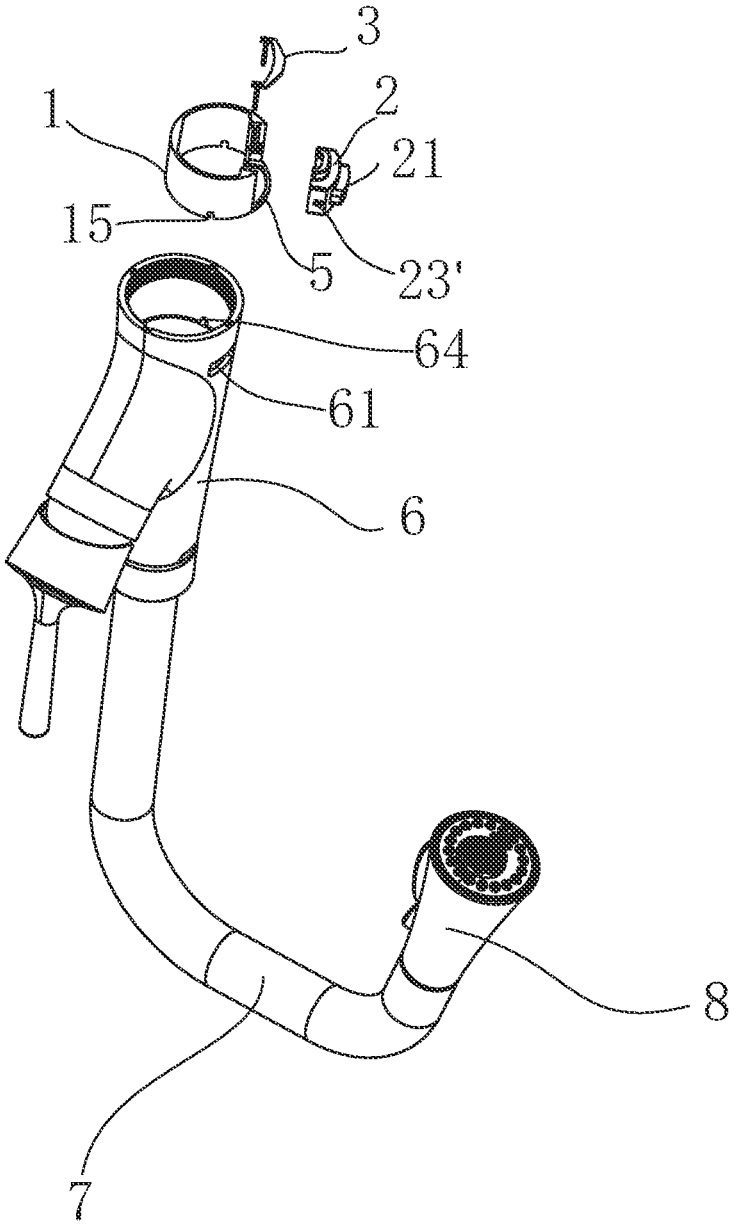
FIG. 15 is an exploded view of embodiment 5 (perspective view)

As shown in FIG. 15, the installation process of this embodiment is as follows: the fixing base 1 is disposed in the inner cavity of the water outlet base 6 in a manner that the notch 12 of the fixing base 1 is towards the installation through hole 61, allowing the sensor 2 to be embedded therein, of the water outlet base 6, afterwards, the sensor 2 stretches into the installation through holes 61 via the hollow cavity 11 of the fixing base 1, and the installation convex blocks 23 of the sensor 2 slide into the installation guide grooves 13 in the two sides of the notch 12 in place (the sensor protrusion is inserted into the installation through hole of the water outlet base), and finally, the fixing bolt 3 is inserted into the insert grooves 14 in the two sides of the notch 12 of the fixing base, and thus, the sensor is assembled on the water outlet base 6. Obviously, compared with the prior art, this embodiment has the advantage that assembly operation is easy and convenient.

Embodiment 2

Figure 10:
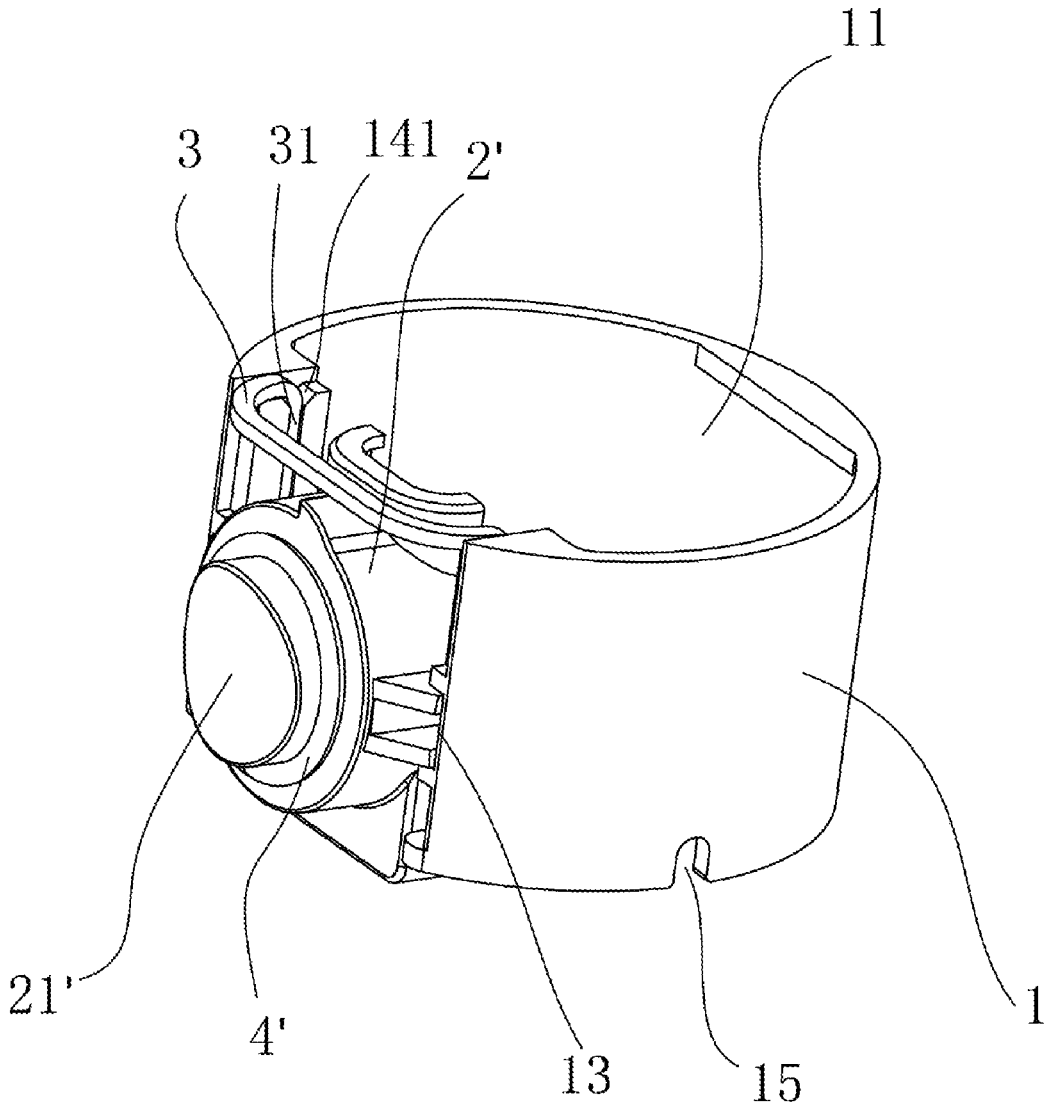
FIG. 10 is an assembled view of embodiment 2 (perspective view)
Figure 11:
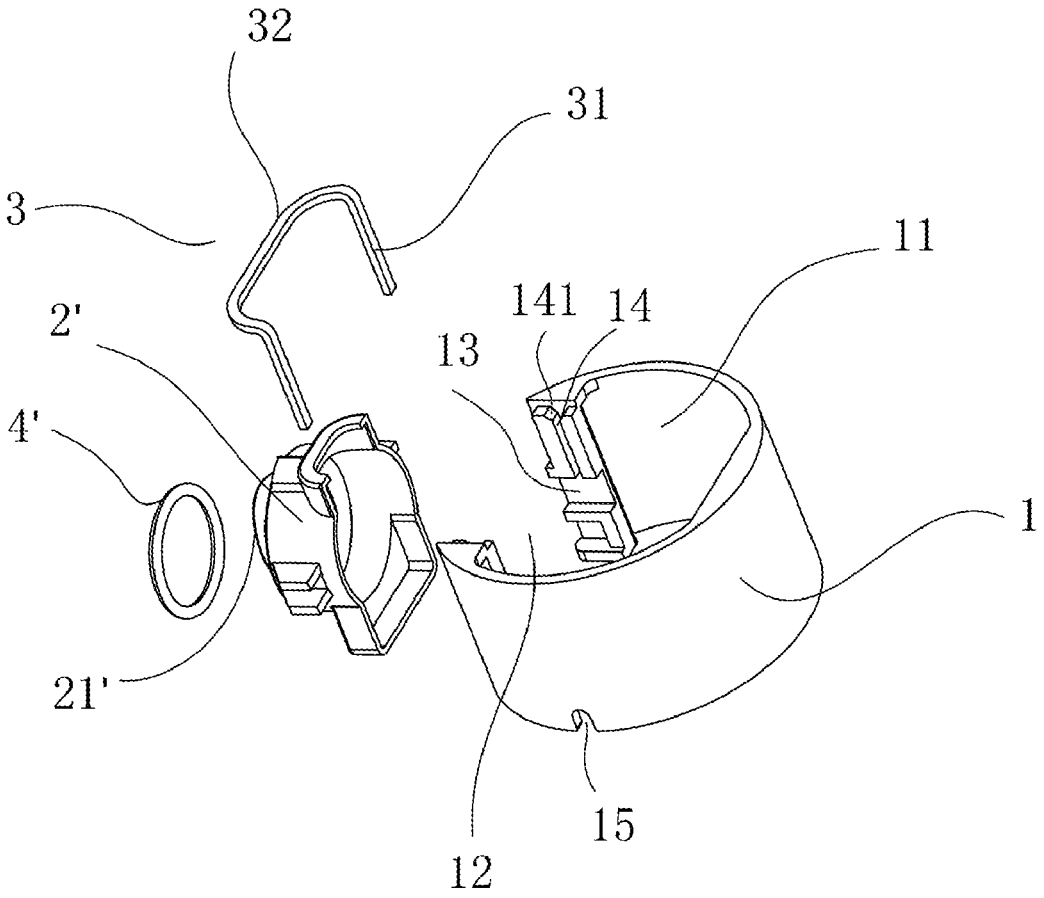
FIG. 11 is an exploded view of embodiment 2 (perspective view)

As shown in FIG. 10 and FIG. 11, embodiment 2 is basically identical with embodiment 1 in structure and differs from embodiment 1 in the following aspects: a sensor 2' is provided with a sensor protrusion 21' having a round contour, and a washer 4' corresponding to the sensor protrusion 21' is also round. This embodiment is applicable to a water outlet base 6 with a round installation through hole.

Embodiment 3

Figure 12:
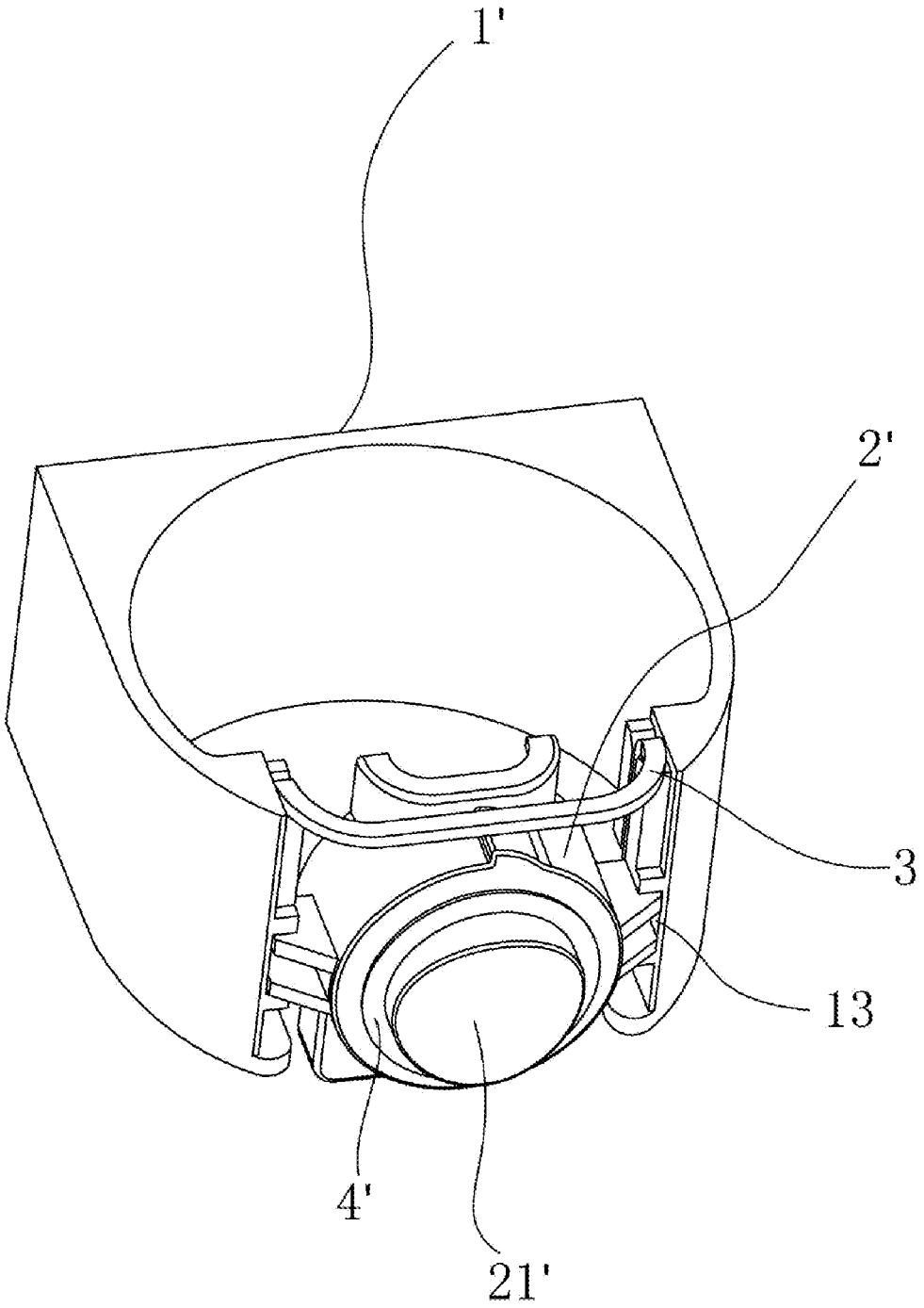
FIG. 12 is an assembled view of embodiment 3 (perspective view)

As shown in FIG. 12, embodiment 3 is basically identical with embodiment 2 in structure and differs from embodiment 3 in the following aspects: a fixing base 1' with a round front portion and a square rear portion is adopted to replace the cylindrical fixing base 1 in the above embodiment, and the fixing base 1' is no longer provided with positioning clamping notches 15 due to the fact that fixing base 1' in this embodiment is to be installed to a water outlet base with an inner cavity in the corresponding shape, which can prevent circumferential slipping without forming the positioning clamping notches 15 in the fixing base 1'.

Embodiment 4

Figure 13:
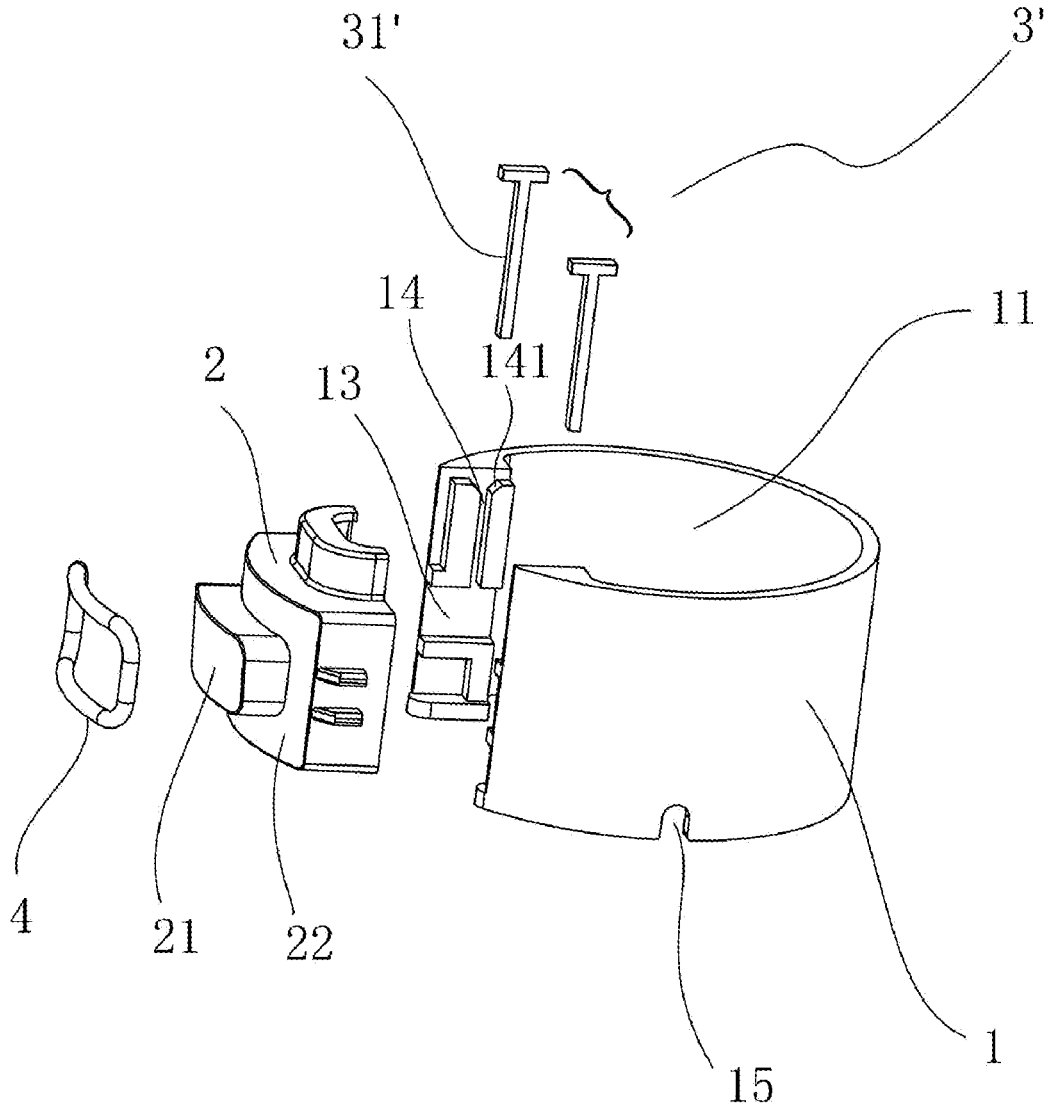
FIG. 13 is an assembled view of embodiment 4 (perspective view)
Figure 14:
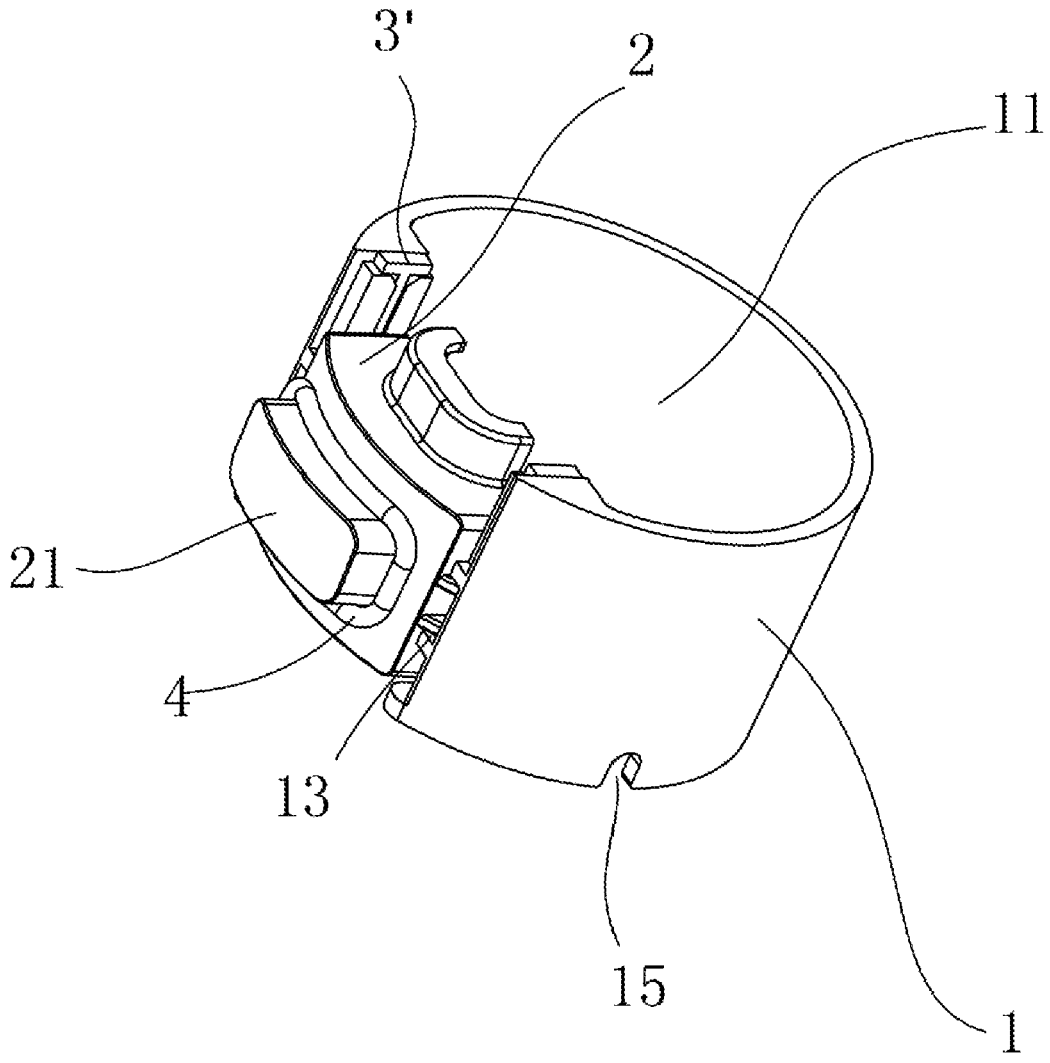
FIG. 14 is an exploded view of embodiment 4 (perspective view)

As shown in FIG. 13 and FIG. 14, embodiment 4 is basically identical with embodiment 1 in structure and differs from embodiment 1 in the following aspects: a fixing bolt 3' formed by two T-shaped insert pins 31' is used to replace the n-shaped fixing bolt 3 in embodiment 1. Compared with embodiment 1, the fixing bolt 3' in this embodiment is lower in cost although assembly operation is slightly complex.

From embodiments 1-4, the sensor installation assembly in the above embodiments all have the advantage over the prior art that assembly operation is easy and convenient. In addition, the sensor installation assembly is obviously applicable to assembly of water outlet bases in various forms and suitable for inner cavities, in different shapes, of water outlet bases and installation through holes, in different shapes, of sensors of water outlet bases and also suitable for installation at different positions of water outlet bases, thereby being more adaptable and universal.

Embodiment 5

Figure 16:
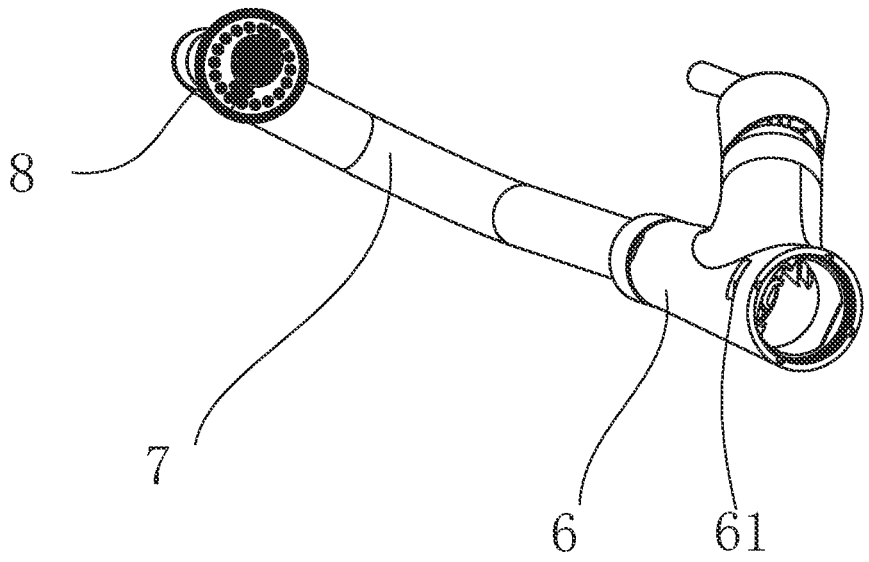
FIG. 16 is an assembled view of embodiment 5 (perspective view 1)
Figure 17:
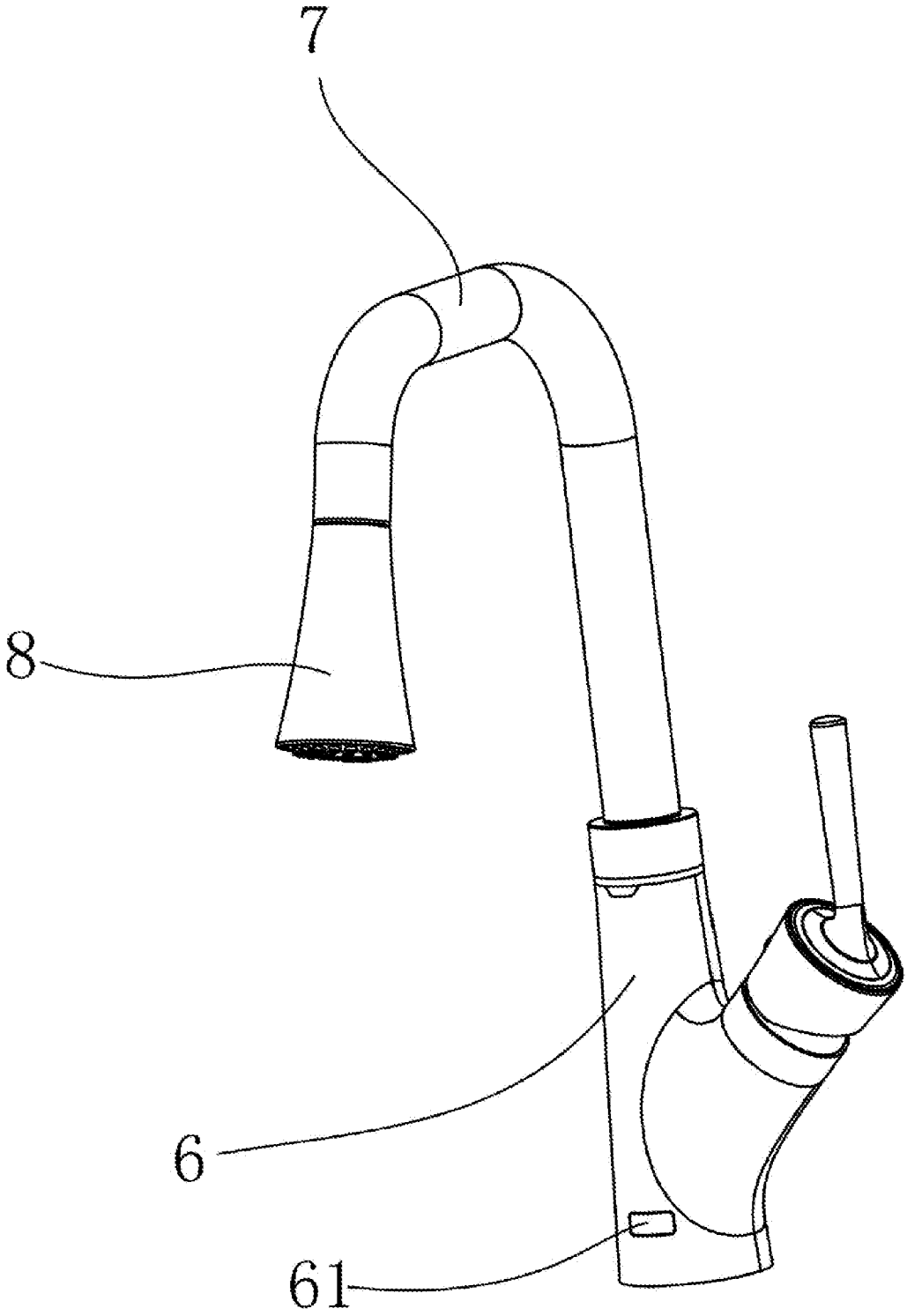
FIG. 17 is an assembled view of embodiment 5 (perspective view 2).

As shown in FIG. 15-17, this embodiment shows a sensor faucet. The sensor faucet comprises a water outlet base 6, an elbow piece 7, a water outlet end piece 8 (water outlet bubbler), a water element assembly (not shown) and a sensor 2, wherein the valve element assembly is installed in a valve element installation hole of the water outlet base 6, a first end of the water outlet base 6 is connected with the elbow piece 7, the tail end of the elbow piece 7 is connected with the water outlet end piece 8, and the water outlet base 6 is provided with a rectangular installation through hole 61 in which the sensor 2 is embedded; and at a second end of the water outlet base 6, the rectangular sensor 2 is installed in the installation through hole 61 of the water outlet base 6 in an embedded manner through the sensor installation assembly.

Embodiment 6

This embodiment explains an installation method of the sensor in embodiment 5. The sensor installation method specifically comprises the following steps:

First, the water outlet base 6 is preferably placed with the second end facing upwards and then is fixed so as to facilitate subsequent installation operation, but this step is not indispensable;

Second, the fixing base 1 is disposed in the inner cavity of the water outlet base 6 till the positioning clamping notches 15 of the fixing base and the positioning clamping blocks 64 of the inner cavity of the water outlet base 6 are cooperatively positioned in place, and at this moment, the notch 12 of the fixing base 1 corresponds to the installation through hole 61 of the water outlet base 6, and the openings of the insert grooves 14 in the two sides of the notch 12 face upwards;

Afterwards, whether or not the washer 4 needs to be installed is determined; if yes, the washer 4 is disposed around the sensor protrusion 21 of the sensor 2, and then the sensor 2 is stretched in via the hollow cavity 11 of the fixing base 1 and is transversely guided in to be installed in the installation guide grooves 13 in the two sides of the notch 12 of the fixing base 1;

Finally, the two insert pins 31 of the n-shaped fixing bolt 3 are inserted in place from the insert grooves 14 in the two sides of the notch 12 of the fixing base, and thus, the sensor 2 is installed on the water outlet base 6.

What needs to be additionally pointed out is that after installation, reinforcement can be conducted according to actual requirements, such as, through glue dispensing, glue filling or the like, and a detailed description will no longer be given herein.

Although the invention is specifically illustrated and introduced with reference to preferred embodiments, those skilled in this field would appreciate that various alterations obtained in form and in detail without deviating from the spirit and scope defined by the claims should fall within the protection scope of the invention.

What is claimed is:

1. A sensor installation assembly, installed into a water outlet base, comprising:

a fixing base, wherein the the fixing base is at least provided with installation guide grooves and insert grooves ; and a sensor, wherein the sensor is in sliding fit with the installation guide grooves of the fixing base; and a fixing bolt, wherein the fixing bolt is inserted into the insert grooves of the fixing base in a matched manner, and the fixing bolt in the insert grooves abuts against the sensor and limits the sensor in the installation guide grooves;

wherein the sensor comprises installation convex blocks in sliding fit with the installation guide grooves of the fixing base;

wherein the sensor further comprises a sensor protrusion and an installation abutting face wider than the sensor protrusion;

wherein a width of the installation convex blocks is smaller than a length of the installation guide grooves; and defining ends, towards the sensor protrusion, in a width direction of the installation convex blocks as front ends, and defining another ends in the wide direction of the installation convex blocks as rear ends, the fixing bolt abuts against the rear ends, in the width direction, of the installation convex blocks after being inserted into the insert grooves of the fixing base in the matched manner.

2. The sensor installation assembly according to claim 1, wherein the fixing base includes a hollow inner cavity.

3. The sensor installation assembly according to claim 1, wherein the sensor installation assembly further comprises a washer disposed around the sensor protrusion.

4. The sensor installation assembly according to claim 1, wherein the fixing base further comprises a positioning structure used for preventing circumferential sliding.

5. A faucet, at least comprising the water outlet base, wherein the sensor installation assembly according to claim 1 is installed on the water outlet base.

6. The sensor installation assembly according to claim 1, wherein the fixing base is provided with a notch, and the installation guide grooves are formed in two sides of the notch.

7. The sensor installation assembly according to claim 6, wherein the installation guide grooves are formed in a radial direction of the fixing base.

8. The sensor installation assembly according to claim 6, wherein a connecting strip is disposed at the notch of the fixing base and is used for connecting two ends of the notch.

9. The sensor installation assembly according to claim 6, wherein the insert grooves are formed in two sides of the notch.

10. The sensor installation assembly according to claim 6, wherein the insert grooves are formed in an axial direction of the fixing base and are communicated with the installation guide grooves.

11. The sensor installation assembly according to claim 6, wherein the fixing bolt is an n-shaped structure or is formed by two T-shaped insert pins.

12. The sensor installation assembly according, installed into a water outlet base, comprising:

a fixing base, wherein the fixing base is at least provided with installation guide grooves and insert grooves ; and a sensor, wherein the sensor is in sliding fit with the installation guide grooves of the fixing base; and a fixing bolt, wherein the fixing bolt is inserted into the insert grooves of the fixing base in a matched manner, and the fixing bolt in the insert grooves abuts against the sensor and limits the sensor in the installation guide grooves;

wherein the fixing base is provided with a notch, and the installation guide grooves are formed in two sides of the notch;

wherein the insert grooves are formed in an axial direction of the fixing base and are communicated with the installation guide grooves;

wherein a flared guide structure is disposed at an opening of each said insert groove.

* * * * *